United States Patent [19]

Orton

[11] Patent Number: 4,998,397

[45] Date of Patent: Mar. 12, 1991

[54] ALIGNMENT AND LATERAL SUPPORT MEMBER FOR USE IN LAYING COMMON CONCRETE BLOCKS

[76] Inventor: Michael V. Orton, 302 W. 100 South, Manti, Utah 84642

[21] Appl. No.: 438,720

[22] Filed: Nov. 17, 1989

[51] Int. Cl.[5] ..... F04B 1/38; E02D 29/02

[52] U.S. Cl. ..... 52/715; 52/166; 52/379; 52/442; 405/286

[58] Field of Search ..... 52/606, 442, 562, 379, 52/715, 166; 405/284, 286

[56] References Cited

U.S. PATENT DOCUMENTS

| | | | |
|---|---|---|---|
| 790,009 | 5/1905 | Streeter | 52/442 X |
| 863,786 | 8/1907 | Curlett | 52/715 |
| 1,088,417 | 2/1914 | Harp | 52/715 |
| 1,146,223 | 7/1915 | Wiswell | 52/715 |
| 1,924,724 | 8/1933 | Olney | 52/379 |
| 4,244,155 | 1/1981 | Swiger | 52/442 |

FOREIGN PATENT DOCUMENTS

| | | | |
|---|---|---|---|
| 605238 | 3/1960 | Italy | 52/715 |

OTHER PUBLICATIONS

Brochure: Versa-Lok Retaining Wall Systems, North St. Paul, Minn.
Brochure: The Allan Block Advantage, Allan Block.
Brochure: Slope Block, Unilock, Inc., N.Y.
Brochure: Stonewall Series, Designer Blocks, Wis.
Brochure: Keystone Retaining Wall Systems, Minnesota, 1988, #2 Keystone Retaining Wall Systems, Minn, 1989.
Brochure: Terrastop, Architectural Earth Retainage and Landscaping System.
Brochure: Rockwood's Split Face, Rockwood Retaining Wall.

*Primary Examiner*—John E. Murtagh
*Attorney, Agent, or Firm*—Terry M. Crellin

[57] ABSTRACT

An alignment and lateral support member for use in laying common concrete blocks. The support member comprises an elongate body piece of rigid material having a length which is greater than the width of concrete blocks with which the support member is to be used. A first appendage extends from a first face of the body piece. The first appendage has a stop surface extending substantially perpendicular to the first face of the body piece, with the stop surface of the first appendage being positioned a distance from the first end of the body piece so that when the stop surface of the first appendage engages an outer surface of the sidewall of a first concrete block, with the first face of the body piece lying adjacent to the first block, the body piece spans from one sidewall of the first block to the other sidewall of the first block. A second appendage extends from a second face of the body piece. The second appendage has a stop surface extending substantially perpendicular to the second face of the body piece, with the stop surface of the second appendage being spaced from the stop surface of the first appendage by a set distance along the body piece in a direction toward the first end of the body piece, whereby the stop surface of the second appendage engages an inner surface of the sidewall of a second concrete block when the second block lies above the first block and in proper position adjacent to the second face of the body piece.

18 Claims, 2 Drawing Sheets

ALIGNMENT AND LATERAL SUPPORT MEMBER FOR USE IN LAYING COMMON CONCRETE BLOCKS

BACKGROUND OF THE INVENTION

1. Field of the Invention

The present invention relates to devices which can be used when laying common concrete blocks to aid in alignment of the blocks as well as to provide lateral support for the blocks.

2. State of the Art

Retaining walls are conventionally made from timbers, stone, poured in place concrete, cast concrete modules and common concrete blocks. The latter is of course the most cost effective with respect to materials used, but generally laying of concrete blocks requires labor intensive installation due in part at least to laying of the blocks with a mortar bonding agent. Stone and cast concrete modules are available which can be formed into a retaining wall using no mortar or other bonding agents. Instead, various methods have been utilized for lateral support and alignment of the modules using mechanical interlocking means between courses of modules in the wall construction.

Interlocking pins have been used between courses of stone and cast concrete modules, but the modules must be provided with preformed openings to accept the interlocking pins. This further increases the cost of already costly precast modules. A clip system has also been suggested wherein the back walls of cast concrete modules are provided with grooves which accept a clip. Such a system is marketed commercially as the Stonewall Series System by Designer Blocks, Inc. of Milwaukee, Wis.

Retaining walls made from common concrete blocks are formed or laid on footings and have been commonly reinforced with steel reinforcement bars which extend vertically through aligned openings in the blocks, with the openings then being filled with backfill, mortar or concrete. Additional support for a retaining wall can be achieved when made from concrete blocks and the other systems mentioned above by providing a deadman type anchor buried in the soil behind the retaining wall. As used throughout the specification and claims, the term "deadman type anchor" is intended to include all types anchors and reinforcement means which can be attached to the wall and is buried beneath the soil behind the wall. The term "deadman type anchor" is specifically intended to include mesh systems such as commonly referred to as geogrid. The mesh systems can be made of metal or polymeric material.

Heretofore, there has been no suggestion of an inexpensive, easily used bracket system which provides lateral support and alignment of common concrete blocks while greatly facilitating the laying of the blocks. There is further no suggestion in the prior art of such a bracket system which can be used to construct a retaining wall from common concrete blocks with no footings being required and no mortar or other bonding agent being used between blocks in the wall. Still further, there is no suggestion in the prior art of such a bracket system for use in constructing a retaining wall from common concrete blocks wherein the brackets can be readily secured to deadman type anchors used to further support the retaining wall.

3. Objectives

A principal objective of the invention is to provide a novel bracket for use in laying common concrete blocks into a wall structure such as a retaining wall.

A particular objective of the present invention is to provide an inexpensive bracket which facilitates laying of common concrete blocks into a wall by providing a means for rapid spacing and alignment of the blocks.

Another objective of the present invention is to provide such a bracket which further provides lateral support to the concrete blocks and can in fact be used to lay a wall in which no mortar or other bonding agent is used between the concrete blocks in the wall.

A further objective of the present invention is to provide such a bracket which achieves uniform vertical alignment or a uniform, desired offset between subsequent courses of blocks without requiring time consuming measurements or use of guide lines.

A still further objective of the present invention is to provide such a bracket which incorporates means for connecting deadman type anchors directly to the bracket for additional lateral support against movement of the retaining wall due to force exerted thereon by the soil retained behind the wall.

BRIEF DESCRIPTION OF THE INVENTION

The above objectives are achieved in accordance with the present invention by providing novel, inexpensive brackets for use in laying common concrete blocks The brackets are quickly and easily installed between blocks as the blocks are being laid. The brackets provide for rapid, accurate, uniform alignment of the blocks as they are being laid, with the brackets further providing superior lateral support for the blocks in the wall. In fact, sufficient lateral support is provided so that the blocks can be laid without the use of mortar or other bonding agents between the blocks In accordance with the invention, the brackets comprise an elongate piece of rigid material having a length which is greater than the width of concrete blocks with which the support member is to be used. A first appendage extends from a first face of the elongate piece. The first appendage has a stop surface extending substantially perpendicular from the first face of the elongate piece, with the stop surface being positioned a set distance from the first end of the elongate piece. When the bracket is positioned on a concrete block such that the first face of the elongate piece lies adjacent to the block, the stop surface of the first appendage engages an outer surface of the sidewall of a first concrete block, with the elongate piece spanning from one sidewall of the block to the other sidewall of the block.

A second appendage is provided on the bracket. The second appendage extends from an opposite, second face of the elongate piece, with the second appendage having a stop surface extending substantially perpendicular from the second face of the elongate piece. The stop surface of the second appendage is spaced from the stop surface of the first appendage by a set distance along the elongate piece in a direction toward the first end of the elongate piece, whereby the stop surface of the second appendage is adapted to engage an inner surface of the sidewall of a second concrete block when the second block lies in proper position above the first concrete block.

The bracket allows the installer to rapidly lay courses after course of concrete block, with very accurate and uniform positioning of the blocks. Further, the brackets provide superior lateral support for the concrete blocks even when installed without the use of mortar or other bonding agent between the blocks.

When the set distance between the stop surfaces of the first and second appendages is made to be the thickness of the sidewall of the concrete blocks being used, course after course of the blocks can be rapidly laid, with the resulting wall being in essentially vertical alignment. To construct a wall which has a uniform set back in subsequent courses, brackets are used in which the set distance between the stop surfaces of the first and second appendages is an increment less than the thickness of the sidewall of the concrete block. The increment is the length of the desired set back between courses of the block. The increment can be any desired distance, preferably being less than the width of the sidewall of the concrete block being used. Most preferably, the increment is any distance up to about one inch.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
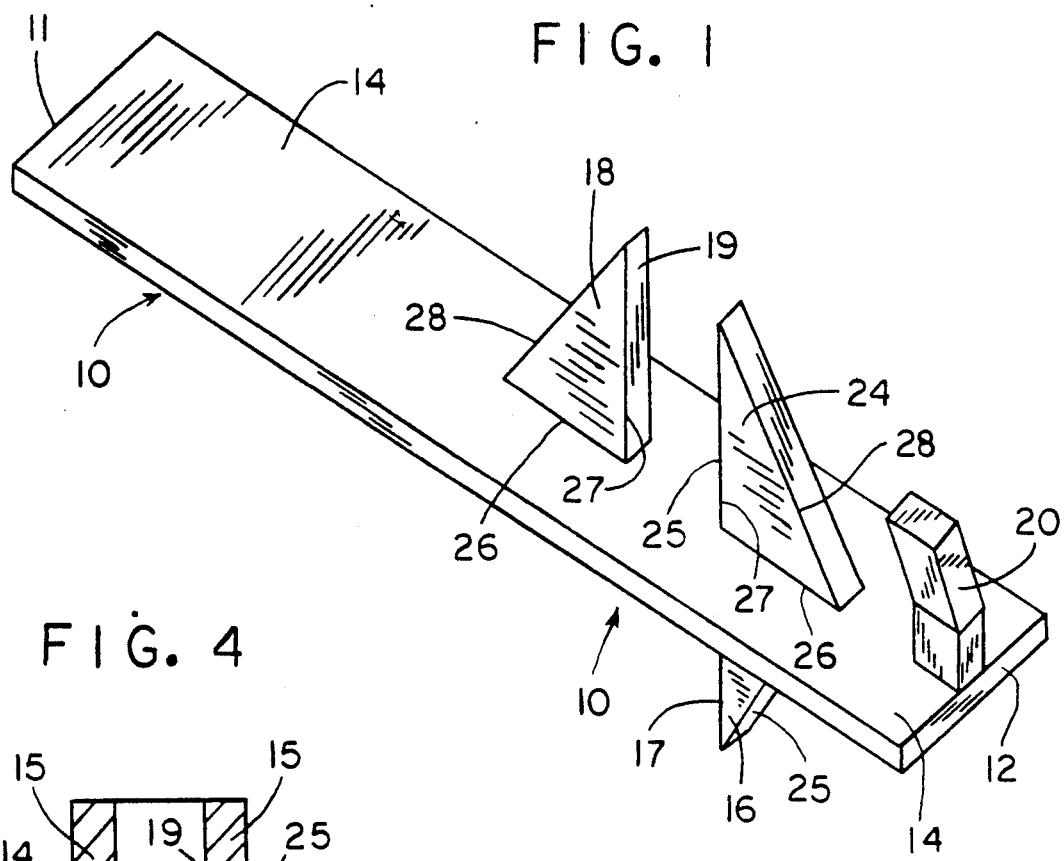
FIG. 1 is a pictorial representation of a bracket in accordance with the present invention.

Referring now to the drawings, there is shown an alignment and lateral support member in accordance with the present invention for use in laying common concrete blocks. In its broadest aspect, the support member comprises an elongate body piece 10 of rigid material. The piece 10 has opposite first and second ends 11 and 12 and opposite first and second elongate faces 13 and 14. The piece 10 further has a length which is greater than the width of the concrete blocks 15 (FIG. 4) with which the support member is to be used. In preferred embodiments, as illustrated in FIGS. 1-7, the elongate piece 10 is a substantially planar strip and advantageously has a width of between about 0.5 inch and 2.5 inches, with a thickness of between about 0.025 inch and 0.25 inch. It should be recognized that the elongate piece 10 could have a different shape than the rectangular shape of the illustrated embodiments. For example, the piece 10 could be an elongate rod which has curvilinear sides so as to have a circular cross section or a flattened, oval-like cross section.

A first appendage 16 extends from the first or lower face 13 of the piece 10. The first appendage 16 has a stop surface 17 extending substantially perpendicular to the first face 13 of the piece 10, with the stop surface 17 being positioned a distance from the first end 11 of the piece 10 so that when the stop surface 17 engages an outer surface of the sidewall of a first concrete block (see FIG. 4), with the first face 13 of the piece 10 lying adjacent to the first or lower block, the piece 10 spans from one sidewall of that block to the other sidewall of that block.

A second appendage 18 extends from the second or upper face 14 of the piece 10. The second appendage 18 has a stop surface 19 extending substantially perpendicular to the second face 14 of the piece 10, with the stop surface 19 being spaced from the stop surface 17 of the first appendage 16 by a set distance along the piece 10 in a direction toward the first end 11 of the piece 10, whereby the stop surface 19 of the second appendage 18 engages an inner surface of the sidewall of a second or upper concrete block (see FIG. 4) when the second block lies in its proper position with respect to the first block and adjacent to the second face 19 of the piece 10.

It should, of course, be recognized that the terms upper and lower faces of the piece 10 are relative and apply only to the embodiments as illustrated. In this respect, it should also be recognized that the first appendage 16 could extend from either of the faces 13 or 14 irrespective of whether that face is an upper or lower face of the elongate piece 10, and the second appendage 18 would then extend from the opposite face.

The set distance between the stop surfaces 17 and 19 of the first and second appendages 16 and 18 is about equivalent to or somewhat less than the thickness of the sidewall of the concrete blocks with which the support member is to be used. In order to set back subsequent courses of blocks, the set distance between the stop surfaces 17 and 19 of the first and second appendages 16 and 18 is less, by a set increment, than the thickness of the sidewall of the concrete blocks with which the support member is to be used. As mentioned previously, the set increment can be up to one inch or more as desired. This set back is illustrated in FIG. 4, wherein the distance between the stop surfaces 17 and 19 of the first and second appendages 16 and 18 is shown less than the thickness of the sidewall of the concrete blocks 15.

Figure 4:
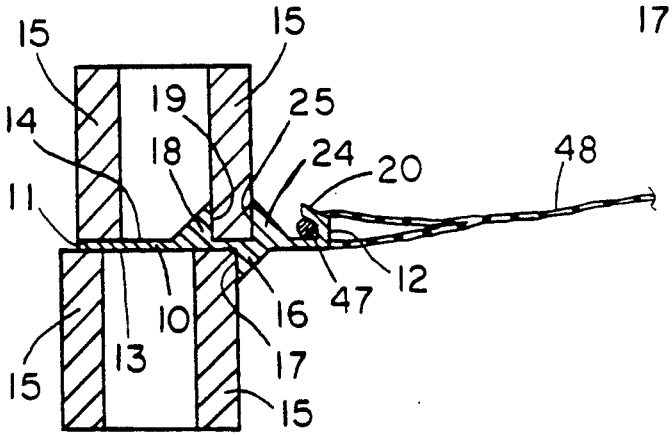
FIG. 4 is a cross sectional view through two courses of block showing the bracket installed between the blocks.
Figure 8:
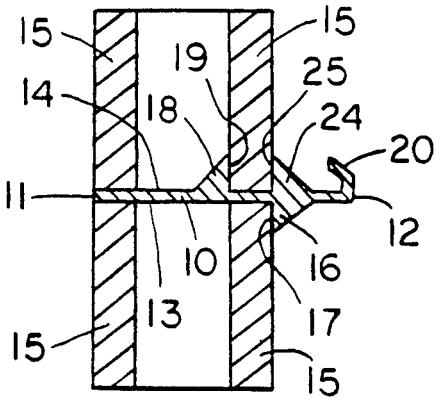
FIG. 8 is a cross sectional view through two courses of block which are not off-set, the bracket being shown installed between the blocks.

The embodiment of the support members shown in FIG. 4 provides a uniform set back for each course of blocks relative to the course of blocks immediately therebelow. The set back is determined by the distance between the stop surfaces 17 and 19. If the distance between the stop surfaces is the same as the thickness of the sidewalls of the blocks 15, there is no set back and subsequent courses of blocks will be aligned vertically (as shown in FIG. 8). If a set back is desired, then support members of FIG. 4 are used in which the distance between the stop surfaces 17 and 19 is less than the thickness of the sidewalls of the blocks 15 as mentioned previously. A preferable range of set backs is between about 0.25 inch and one inch.

Figure 2:
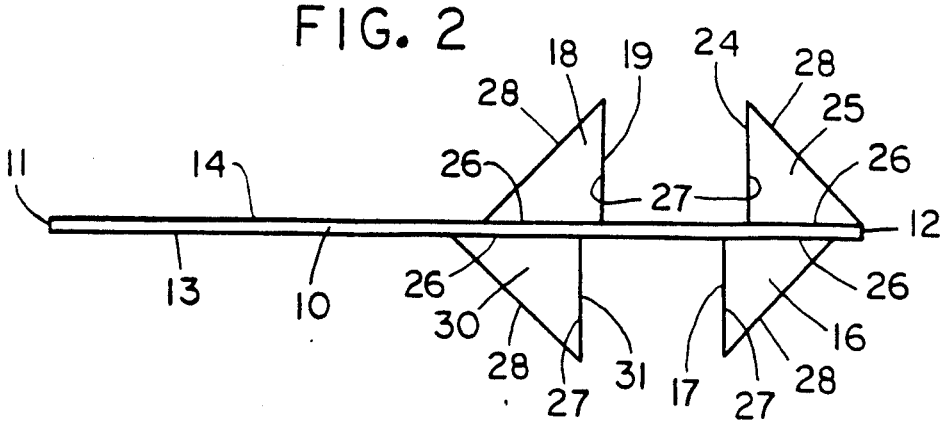
FIG. 2 is a side elevation view of a bracket similar to that of FIG. 1 but showing a variation in the set distance between the stop surfaces of the first and second appendages and with the means for attaching an anchor to the one end of the bracket being removed.
Figure 3:
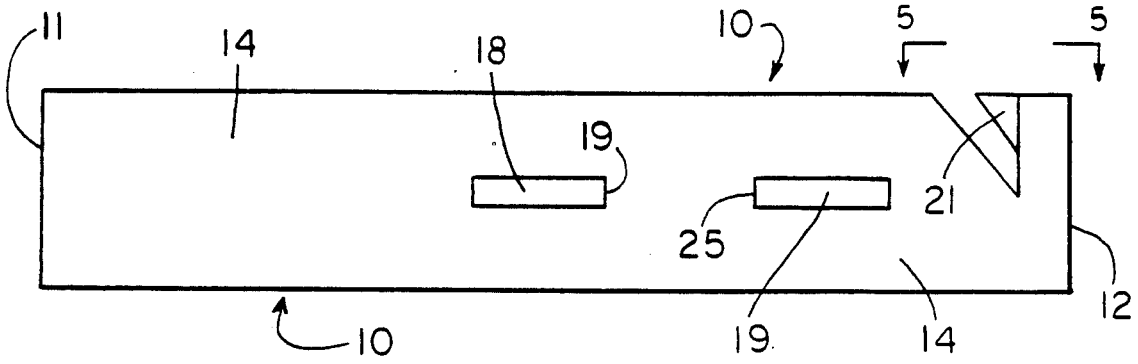
FIG. 3 is a top view of a bracket similar to that of FIG. 1 but showing a variation in the means for attaching an anchor to the bracket.

The elongate piece 10 of the support member of the present invention can be further provided with an anchor attaching means located adjacent to the second end 12 of the piece 10. The anchor attaching means as shown in FIGS. 1, 2 and 4 comprises a hook appendage 20 attached adjacent to the second end of the piece 10. As shown in FIG. 3, the anchor attaching means comprises a raised and bent hook 21 formed in the piece 10 adjacent to the second end 12 thereof.

The anchor attaching means permits deadman type anchors to be attached to the support member so as to provide additional lateral support to a retaining wall. The deadman type anchors extend, as is well known in the art, into the soil behind the retaining wall. Various types of deadman anchors can be attached to the anchor attaching means of the present invention. In a preferred embodiment, the deadman anchor includes a sheet of mesh material. A rod 47 extends between the hook appendages 20 or hooks 21 to lie along the inside face of the retaining wall which is being constructed. The sheet of mesh 48 is attached uniformly along the rod 47 and extends from the rod 47 into the soil behind the wall. The rod 47 transfers loading uniformly from the mesh to the hook appendages 20 or hooks 21 of the support members. Inasmuch as deadman anchors are only used in every third or so courses of blocks in a wall, the support members of the present invention which are used between courses of blocks to which no deadman anchors are to be attached need not incorporate the anchor attaching means. Such a support member which does not have the anchor attaching means is shown in FIG. 2.

In one of the preferred embodiments of the support member of the present invention there is further provided a third appendage 24 extending from the second or upper face 14 of the piece 10. The third appendage 24 has a stop surface 25 extending substantially perpendicular to the second face 14 of the piece 10, with the stop surface 25 of the third appendage 24 being spaced from the stop surface 19 of the second appendage 18 by a set distance along the piece 10 in a direction away from the first end 11 of the piece 10, whereby the stop surface 25 of the third appendage 24 engages the outer surface of the sidewall of an upper block.

A fourth appendage 30 (see FIG. 2) can also be provided if so desired. The fourth appendage 30 extends from the first or lower face 13 of the piece 10. The fourth appendage 30 has a stop surface 31 extending substantially perpendicular to the first face 13, with the stop surface 31 of the fourth appendage 30 being spaced from the stop surface 17 of the first appendage 16 by a distance equivalent to the thickness of the sidewalls of the concrete blocks being used.

Although not essential elements of the present invention, the third and fourth appendages 24 and 30 and associated stop surfaces 25 and 31 are highly advantageous. Whether incorporated singly or together in the support member of the present invention, the third and fourth appendages 24 and 30 greatly aid in the rapid placement and alignment of the new course of blocks over the previous laid course. The third appendage and/or the fourth appendages 24 and 30 and their associated stop surface 25 and 31 lock the new block in proper position and holds the block firmly in place while other blocks are being laid.

The first, second, third and fourth appendages 16, 18, 24 and 31 are preferably formed from substantially planar plates having first and second sides 26 and 27 (see FIGS. 1 and 2) which extend from a common junction and are oriented perpendicular to each other. The first sides 26 of the respective plates are attached to the piece 10, and the second sides 27 of the respective plates form the respective stop surfaces 17, 19, 25 and 31 of the appendages. As illustrated in the drawings, the first, second, third and appendages 16, 18, 24 and 30 are formed from plates having a triangular shape with a third side 28 of each plate interconnecting respective, extending ends of the first and second sides 26 and 27. The first, second, third and fourth appendages 16, 18, 24 and 30 preferably have a thickness of between about 0.025 inch and 0.25 inch.

Figure 6:
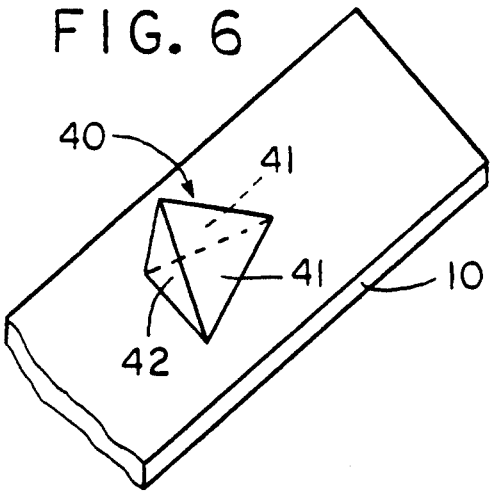
FIG. 6 is a partial pictorial view of a bracket in accordance with the invention showing a variation in the shape of the appendages formed on the bracket.
Figure 7:
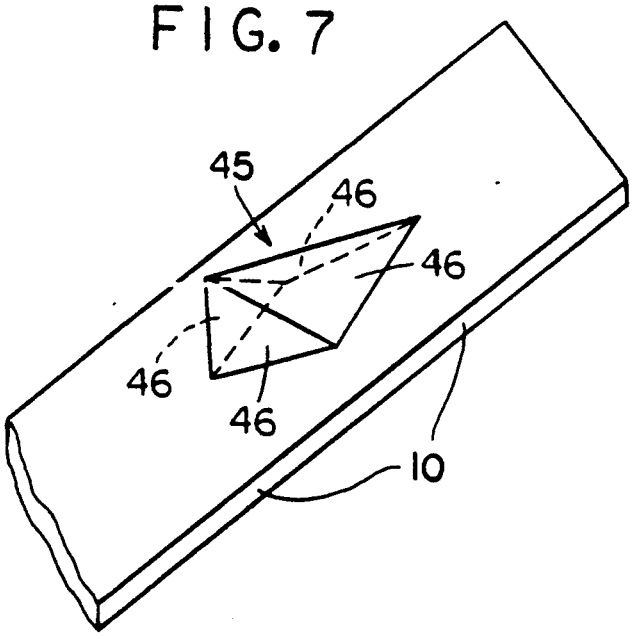
FIG. 7 is a partial pictorial view similar to that of FIG. 6 showing yet another variation in the shape of the appendages formed on the bracket.
Figure 5:
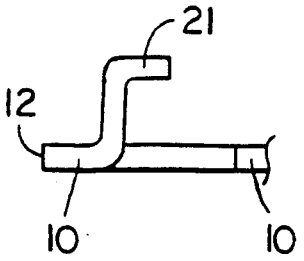
FIG. 5 is a partial side view of the bracket of FIG. 3, taken along line 5—5 of FIG. 3.

An alternate shape which is applicable to any of the appendages 16, 18, 24 and 30 is shown in FIG. 6. The appendage 40 shown in FIG. 6 has the shape of a pyramid which has been cut in half. Two triangular sides 41 diverge from the apex of the pyramid-like member to form the sides of the appendage 40. A triangular front surface 42 also extends from the apex and forms the stop surface. Another alternative shape which is applicable to any of the appendages 16, 18, 24 and 30 is shown in FIG. 7. The appendage 45 is similar to that of FIG. 6 but has the shape of a modified pyramid. Four triangular sides 46 diverge from the apex of the pyramid to form the sides of the appendage 45. The apex of the modified pyramid is further positioned perpendicular to one of the points of the base of the pyramid, with the side edge 47 of the modified pyramid being perpendicular and extending from the apex to the point below the apex in the base of the pyramid. The edge 47 forms the stop surface. The edge 47 can be given a slight curvature rather than being a sharp edge. It is advantageous to use support members which have the pyramid shaped appendages, such as shown in FIG. 7, when the support members are used in constructing a curved retaining wall. The edge 47 accommodates different angles and block alignment necessary when the blocks are formed into a curved retaining wall.

The body piece 10 and the appendages 16, 18, 20, 24 and 30 are all made of a rigid material, such as metal or high strength polymers. Reinforced polymers are advantageous because of their strength, low cost and the ease of forming the parts from such material. The appendages can be attached to the body piece by several methods. When the items are made of metal, the parts can be welded together. When the items are made of polymers, the appendages are formed integrally as by casting or molding with the body piece.

Although preferred embodiments of the support member or bracket of the present invention have been illustrated and described, it is to be understood that the present disclosure is made by way of example and that various other embodiments are possible without departing from the subject matter coming within the scope of the following claims, which subject matter is regarded as the invention.

I claim:

1. An alignment and lateral support member for use in laying common concrete blocks, said support member comprising an elongate piece of rigid material, said piece having opposite first and second ends and opposite first and second elongate faces, with said piece further having a length which is greater than the width of concrete blocks with which the support member is to be used;

a first appendage extending from said first face of said piece, said first appendage having a stop surface extending substantially perpendicular to said first face of said piece, with the stop surface of said first appendage being positioned a distance from the first end of said piece so that when the stop surface of said first appendage engages an outer surface of the sidewall of a first concrete block, with said first face of said piece lying adjacent to said first block, said piece spans from one sidewall of said first block to the other sidewall of said first block; and a second appendage extending from said second face of said piece, said second appendage having a stop surface extending substantially perpendicular to said second face of said piece, with the stop surface of said second appendage being spaced from said stop surface of said first appendage by a set distance along said piece in a direction toward said first end of said piece, whereby the stop surface of said second appendage engages an inner surface of the sidewall of a second concrete block when said second block lies in proper position adjacent to said second face of said piece, the set distance between said top surfaces of said first and second appendages is up to about 1 inch less than the thickness of the sidewall of the concrete blocks with which the support member is to be used.

2. A support member in accordance with claim 1, wherein the set distance between said stop surfaces of said first and second appendages is about the thickness of the sidewall of the concrete blocks with which the support member is to be used.

3. A support member in accordance with claim 1, wherein said piece has opposite, elongate upper and lower faces;

the first appendage extends downwardly from the lower face of said piece, with the stop surface of said first appendage extending substantially perpendicular to said lower face of said piece to engage the outer surface of the sidewall of said first block when said first block is positioned immediately below and adjacent to said first face of said piece; and the second appendage extends upwardly from the upper face of said piece, with the stop surface of said second appendage extending substantially perpendicular to said upper face of said piece to engage the inner surface of the sidewall of said second block when said second block is positioned immediately above and adjacent to said second face of said piece.

4. A support member in accordance with claim 3, wherein the set distance between said stop surfaces of said first add second appendages is about the thickness of the sidewall of the concrete blocks with which the support member is to be used.

5. A support member in accordance with claim 3, wherein said elongate piece is further provided with an anchor attaching means located adjacent to said second end of said piece.

6. A support member in accordance with claim 5, wherein said anchor attaching means comprises a hook appendage attached adjacent to said second end of said piece.

7. A support member in accordance with claim 5, wherein said anchor attaching means comprises a hook formed in said piece adjacent to said second end thereof.

8. A support member in accordance with claim 3, wherein there is further provided a third appendage extending upwardly from the upper face of said piece, said third appendage having a stop surface extending substantially perpendicular to said upper face of said piece, with the stop surface of said third appendage being spaced from the stop surface of said second appendage by a set distance along said piece in a direction away from said first end of said piece, whereby the stop surface of said third appendage engages the outer surface of the sidewall of said second block when said second block is properly positioned above said piece.

9. A support member in accordance with claim 8, wherein the set distance between said stop surfaces of said first and second appendages is about the thickness of the sidewall of the concrete blocks with which the support member is to be used.

10. A support member in accordance with claim 3, wherein said elongate piece is a substantially planar strip which has a width between about 0.5 inch and 2.5 inches and a thickness of between about 0.025 inch and 0.25 inch.

11. A support member in accordance with claim 10, wherein the first and second appendages are formed from elongate members having first and second sides which extend from a common junction and are oriented perpendicular to each other, with the first sides of the respective plates being attached to said strip and with the second sides of the respective plates forming the respective stop surface of said appendages.

12. A support member in accordance with claim 11, wherein the first and second appendages are formed from plates having a triangular shape with a third side of each plate interconnecting respective, extending ends of said first and second sides.

13. A support member in accordance with claim 1, wherein the first and second appendages have a thickness of between about 0.025 inch and 0.25 inch.

14. A support member in accordance with claim 1, wherein there is further provided a third appendage extending from the second face of said piece, said third appendage having a stop surface extending substantially perpendicular to said second face of said piece, with the stop surface of said third appendage being spaced from the stop surface of said second appendage by a set distance along said piece in a direction away from said first end of said piece, whereby the stop surface of said third appendage engages the outer surface of the sidewall of said second block when said second block is properly positioned above said piece.

15. A support member in accordance with claim 14, wherein the set distance between said stop surfaces of said first and second appendages is about the thickness of the sidewall of the concrete blocks with which the support member is to be used.

16. A support member in accordance with claim 1, wherein said elongate piece is further provided with an anchor attaching means located adjacent to said second end of said piece.

17. A support member in accordance with claim 16, wherein said anchor attaching means comprises a hook appendage attached adjacent to said second end of said piece.

18. A support member in accordance with claim 16, wherein said anchor attaching means comprises a hook formed in said piece adjacent to said second end thereof.

* * * * *